United States Patent [19]

Bowsky et al.

[11] Patent Number: 4,584,433

[45] Date of Patent: Apr. 22, 1986

[54] HERMETIC TERMINAL ASSEMBLY

[75] Inventors: Benjamin Bowsky; Glenn A. Honkomp, both of Warren County; Larry G. Burrows, Hamilton County, all of Ohio

[73] Assignee: Emerson Electric Co., St. Louis, Mo.

[21] Appl. No.: 669,249

[22] Filed: Dec. 3, 1984

[51] Int. Cl.[4] ..... H01B 17/30; H01R 13/74

[52] U.S. Cl. ..... 174/152 GM; 339/192 RL

[58] Field of Search ..... 174/152 GM, 153 R; 339/192 RL

[56] References Cited

U.S. PATENT DOCUMENTS 2,417,552 3/1947 Ilker et al. ..... 174/153 R
4,296,275 10/1981 Bowsky ..... 174/152 GM
4,461,925 7/1984 Bowsky et al. ..... 174/152 GM

FOREIGN PATENT DOCUMENTS 0073731 3/1983 European Pat. Off. .... 174/152 GM

*Primary Examiner*—Laramie E. Askin
*Attorney, Agent, or Firm*—Polster, Polster and Lucchesi

[57] ABSTRACT

A hermetic terminal assembly wherein a radially extending flange on a current conducting pin that extends through a hole defined by a cover member adapted to be secured to an opening in a motor housing is surrounded by an electrically insulating sleeve with the inner axial extremity of the sleeve extending at an axial location relative the pin substantially beyond the inner face of the radially extending flange to provide an extended tortuous path between the flange on the pin and the cover member, the pin having a reduced neck portion on the inner end thereof adjacent the inner face of the flange to provide a fuse-like area.

6 Claims, 6 Drawing Figures

HERMETIC TERMINAL ASSEMBLY

BACKGROUND OF THE INVENTION

The present invention relates to further variations in the construction of the hermetic terminal assemblies disclosed in U.S. Pat. No. 4,296,275, issued to Benjamin Bowsky on Oct. 20, 1981 and in U.S. Pat. No. 4,461,925, issued to Benjamin Bowsky and Glenn A. Honkomp on July 24, 1984.

In both U.S. Pats. No. 4,296,275 and U.S. Pat. No. 4,461,925, the inner end of the pin—that is the end of the pin on the dish side surface of the cup-shaped body—is provided with a radially extending flange of a major diameter larger than the diameter of the hole defined by an annular sealing lip, the flange being axially located relative the pin adjacent the inner extremity of an electrically insulating sleeve surrounding the pin in immediate or close proximity to such pin and, in U.S. Pat. No. 4,461,925, a reduced neck to provide, in effect, a fuse-like area is positioned axially relative the pin immediately adjacent the seal on the outside surface of the cup-shaped body.

The present invention, recognizing the desirability of controlling the area of possible pin melting, of preventing the pin from shorting to the housing shell, of preventing the pin from leaving the housing shell, of improving sealing and minimizing leakage and providing maximum insulating surface between the pin and housing, provides a hermetic terminal assembly capable of obtaining these desirable features and yet which is straightforward, efficient and economical to manufacture and assemble, providing a terminal assembly which utilizes a minimum of materials and which is safer than many of the terminal assemblies known heretofore.

Various other features of the present invention will become obvious to one skilled in the art upon reading the disclosure set forth hereinafter.

SUMMARY OF THE INVENTION

More particularly, the present invention provides a hermetic terminal assembly adapted to be secured to an opening in a motor unit housing comprising: a cover member for such opening having at least one hole therein; a current conducting pin extending through the hole, the pin having an outer end to extend externally of the housing to receive an electrical connection to a current source and an inner end to extend within the housing to receive an electrical connection to a motor disposed in the housing, the inner end of the pin having a flange extending radially therefrom; a seal bonding the pin to the surface defining the cover member hole; and a hollow electrically insulating sleeve surrounding the pin and flange extending therefrom with the inner axial extremity of the sleeve extending at an axial location relative the pin substantially beyond the axial location of the inner face of the flange and the opposite axial extremity of the sleeve being bonded to the seal to provide an extended tortuous path between the flange on the pin and the cover member to minimize the possibilities of electrical arcing therebetween. In addition, the present invention provides a reduced neck portion on the current conducting pin extending axially from the inner face of the flange of the pin to the inner extremity of the sleeve to form, in effect, a fuse-like area, and a flange which is smaller than the hole defined in the cover member and which is prevented from passing through the hole in the event of seal softening by an inner ledge on the sleeve and the tapered conformity of the tapered outer sleeve wall and tapered inner extremity of the hole defined in the cover member.

It is to be understood that various changes can be made in the general arrangement, materials and construction of the apparatus disclosed herein without departing from the scope or spirit of the present invention.

BRIEF DESCRIPTION OF THE DRAWINGS

Referring to the drawing which discloses one advantageous embodiment of the inventive terminal assembly and a modified alternative pin arrangement therefor.

Figure 2:
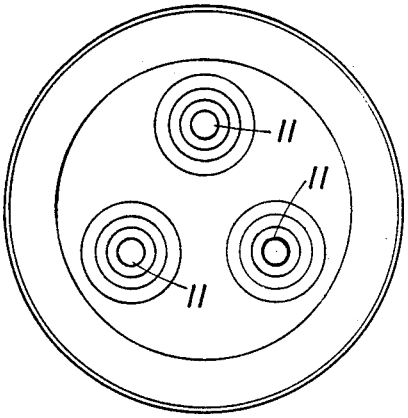
FIG. 2 is an end view of the assembly of FIG. 1 taken in a plane through line 2—2 of FIG. 1.
Figure 1:
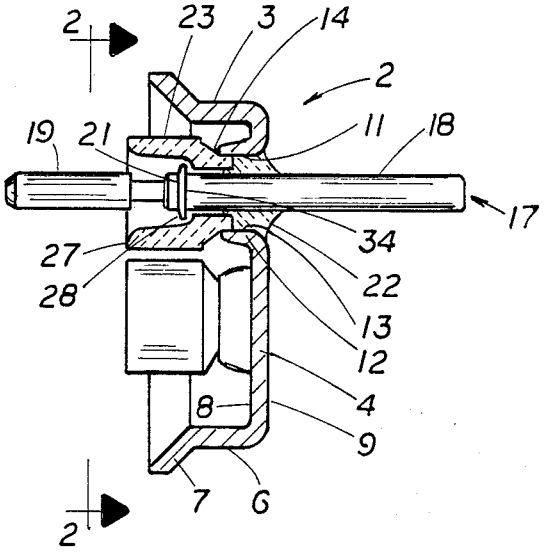
FIG. 1 is a view, partly in section and partly broken away, of the inventive terminal assembly disclosing the novel sleeve and pin arrangement.

As can be seen in FIG. 1, the hermetic terminal assembly of the present invention, broadly indicated by reference numeral 2, includes a cover member which in the drawing is shown as a cup-shaped body 3 having a generally flat bottom 4 and a sidewall 6 with an outwardly flaring rim 7. The flat bottom 4 has a dish or inner surface 8 and an outer or outside surface 9 and at least one hole or opening 11 defined by annular sealing lip 12 extending from inner surface 8 with an inside wall surface 13, a free inner extremity or edge 14 and a radius or outside edge 16. As can be seen in FIG. 2, cup-shaped body 3 is, in fact, provided with three such openings 11, all of which can incorporate similar annular sealing lip arrangements as described heretofore and similar pin and sleeve arrangements as described hereinafter.

As can again be seen in FIG. 1, extending through each hole 11 is a current conducting pin 17. Each pin 17 includes an outer end 18 which extends externally of cup-shaped body 3 and, of course, the motor unit housing having an opening in which the terminal assembly 2 is mounted (not illustrated herein). The outer end 18 serves to be connected to a suitable electric current source (also not illustrated herein). Each pin 17 further includes an inner end 19 which extends beyond annular sealing lip 12, this inner end serving to receive an electrical connection disposed in the motor unit housing to which assembly 2 is mounted.

Figure 3:
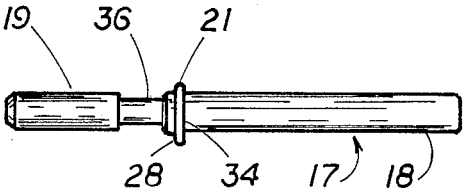
FIG. 3 is an enlarged view of the current conducting pin of FIG. 1.

As can be seen in FIGS. 1 and 3, inner end 19 of pin 17 includes a flange 21 extending generally radially therefrom. It is to be noted that in the embodiment disclosed flange 21 is less than the diameter of hole 11 defined by annular sealing lip 12. With such an arrangement of a small diameter flange it is possible to form the pin and flange by a suitable forming process from a corrosion resistant, stainless steel with a high chromium content, thus enhancing the bonding process of the pin in the glass seal, described hereinafter. Referring particularly to FIG. 1, it can be seen that when pin 17 is assembled with cup-shaped body 3, flange 21 is positioned in the embodiment disclosed at an axial location relative cup-shaped body 3 intermediate the inner extremity 14 of annular sealing lip 12 and the inner extremity of flaring rim 7 of cup-shaped body 3. To bond pin 17 in this selected position to the inner wall surface 13 of annular sealing lip 12, a glass seal 22 is provided, this glass seal, which is heat softened in an oven in the bonding process, also serves to receive and bond in place an extremity of hollow electrically insulating sleeve 23 which can be of a suitable ceramic such as alumina or steatite.

Figure 6:
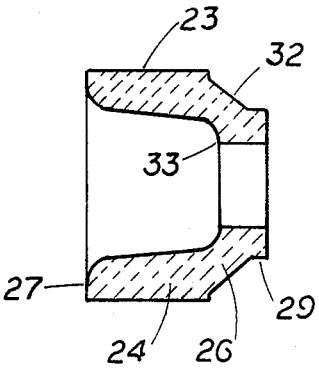

Referring to FIG. 6, it can be seen that ceramic sleeve 23 includes a hollow cylindrical body portion 24 and a truncated cone portion 26. As can be seen in FIG. 1, when the terminal is assembled, the cylindrical body portion 24 is sized to have an inner wall diameter larger than the diameter of hole 11 defined by annular sealing lip 12 to surround pin 17 and flange 21 radially extending from pin 17. It is to be noted that the inner axial extremity 27 of cylindrical body portion 24 extends at an axial location relative pin 17 substantially beyond the axial location of inner face 28 of flange 21. Thus, with this arrangement of the terminal assembly 2, the tortuous distance of free travel from flange 21 to the inner edge 14 of annular sealing lip 12 would be along the inner and outer walls of cylindrical body portion 24 of sleeve 23 and a substantial portion of the outer wall of truncated cone portion 26, thus minimizing the possibilities of electrical arcing between flange 21, which, as aforenoted, is of reduced diameter, and annular sealing lip 12.

To enhance the assembly and bonding of ceramic sleeve 23 to glass seal 22 and annular lip 12, the extremity of truncated cone portion 26 of ceramic sleeve 23 is provided with a generally cylindrical extremity 29. The outer wall diameter of cylindrical extremity 29 is sized to conform closely with and nest in hole 11 defined by annular sealing lip 12 and is of sufficient axial breadth to engage with and be bonded to glass seal 22 during the bonding process.

Figure 5:
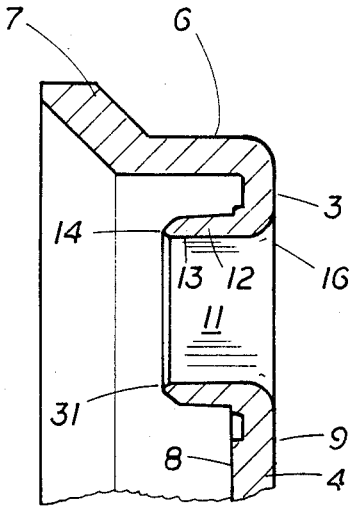
FIG. 5 is an enlarged cross-sectional view of a portion of the cup-shaped body of FIG. 1, disclosing in more detail the tapered inner wall extremity of the annular sealing lip; and, FIG. 6 is an enlarged cross-sectional view of the novel insulating sleeve disclosed in FIG. 1.

Referring particularly to FIGS. 5 and 6, it is to be noted that the inner edge or extremity 14 of annular sealing lip 12 is tapered along the inner wall thereof, as indicated by reference numeral 31, to conform with tapered outer wall 32 of truncated cone portion 26 of ceramic sleeve 23 which bears thereagainst. It further is to be noted that the inner wall of truncated portion 26 of sleeve 23 includes an inner annular ledge 33 which is of a diameter less than the diameter of flange 21. This ledge 33 serves to arrest flange 21 in the event of glass seal softening.

As can be seen in FIG. 1, in assembly, the opposite face 34 of flange 21 is axially spaced from annular ledge 33 a sufficient distance to accommodate for the different coefficients of expansion of the ceramic sleeve 23, the glass seal 22, the cup-shaped body 3 and the stainless steel pin 17. It is to be understood that the spacing would vary, depending upon the types of materials utilized for the aforedescribed parts.

Referring to FIGS. 1 and 3, it can be seen that the inner end 19 of pin 17 has a reduced generally cylindrical neck portion 36 which is arranged to extend axially substantially from the inner face 28 of flange 21 to the inner axial extremity 27 of the cylindrical body portion 24 of sleeve 23. The neck serves to form, in effect, a fuse-like area so that if excessive heating of the pin occurs, the pin will melt in this area and thereby protect both the motor and persons in the vicinity. When this occurs, contained gas forces in the housing will likely cause opposite face 34 of flange 21 to abut against annular ledge 33 in truncated cone portion 26 of sleeve 23 to thus retain the outer end 18 of pin 17, transmitting the force through the conforming tapered outer wall 32 of truncated cone 26 and tapered extremity 31 along the inner wall of annular sealing lip 12.

Figure 4:
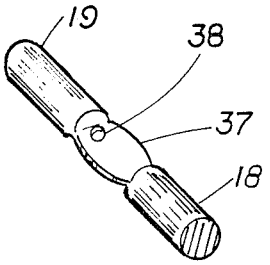
FIG. 4 is an enlarged perspective view of a portion of a modified alternative conducting pin.

Referring to FIG. 4, a modified necking arrangement for pin 17 is disclosed. This necking arrangement includes a reduced flattened neck portion 37, the radially widest portion of which serves in place of flange 21, the necking arrangement being sized to extend axially along substantially the entirety of the length of the cylindrical body portion 24 of sleeve 23 from truncated cone portion 26 to the inner axial extremity 27 of body portion 24, the radially extending flattened neck portion 37 serving both as a fuse-like area and as a flange in the event of pin melting.

As disclosed in FIG. 4, an opening or aperture 38 is provided in neck portion 37. Opening or aperture 38 is positioned axially adjacent the inner end 19 of pin 17 and the inner extremity of sleeve 23 and axially inward of the radially widest portion of flattened neck 37.

Thus, from the above it can be seen that the present invention provides a novel hermetic terminal assembly which can be readily manufactured and assembled to control the area of possible pin melting, to prevent the pin from shorting and leaving the housing shell and to improve sealing, providing maximum surface between pin and housing.

It is to be understood that various changes can be made in the embodiment disclosed without departing from the scope or spirit of the present invention. For example, it would be possible to provide a flat cover member without a rim 7 and/or an annular sealing lip 12, the cover member being of sufficient thickness to insure sealed bonding between the surface defining the cover member hole and the pin. It also would be possible to provide a cover member, flat or with a rim, with an annular sealing lip 12 which extends in an opposite direction from the lip as disclosed in the drawing—that is from outside wall surface 9.

The invention claimed is:

1. A hermetic terminal assembly adapted to be secured to an opening in a motor unit housing comprising: a cup-shaped body with a bottom and a rim extending in one direction from the bottom, said bottom having at least one hole in it defined by an annular sealing lip projecting in the same direction as said rim; a current conducting stainless steel pin extending through said hole, said pin having an outer end to extend externally of said housing to receive an electrical connection to a current source and an inner end to extend beyond said lip to receive an electrical connection disposed in said housing, said inner end of said pin having a flange extending generally radially therefrom of a diameter less than the diameter of said hole defined by said annular lip, said flange being positioned at an axial location relative said cup-shaped body intermediate the extremity of said annular sealing lip and the extremity of said rim of said cup-shaped body, said flange having an inner face facing said inner end of said pin and an opposite face facing said outer end of said pin; a glass seal bonding said pin to the inside surface of said lip; and a hollow, electrically insulating ceramic sleeve, said sleeve including a cylindrical body portion and a truncated cone portion, said cylindrical body portion having an inner wall diameter larger than the diameter of said hole defined by said annular lip to surround said pin and said flange extending therefrom with the inner axial extremity of said cylindrical body portion extending at an axial location relative said pin substantially beyond the axial location of the inner face of said flange, said truncated cone portion having an extension of generally cylindrical shape with the outer wall diameter thereof sized to nest closely with said hole defined by said annular lip and engaging with and being bonded to said glass seal, the inner wall extremity of said annular lip being tapered to conform with the tapered outer wall of said generally truncated cone portion of said sleeve which bears thereagainst, the inner wall of said truncated cone portion of said sleeve including an annular ledge of a diameter less than the diameter of said flange of said pin to arrest said flange in the event of pin melting, the opposite face of said flange being axially spaced from said annular ledge on the inner wall of said truncated portion of said insulating sleeve to accommodate for different coefficients of expansion of the differing materials; said inner end of said pin having a reduced neck portion extending axially substantially from the inner face of said flange to the inner axial extremity of said sleeve to form, in effect, a fuse-like area which, when melted results in contained gas forces likely to cause the opposite face of said flange to abut said annular ledge to retain said outer end of said pin, transmitting the forces through the conforming truncated wall portion and tapered annular lip portion of said cup-shaped body.

2. The apparatus of claim 1, wherein said reduced neck portion is a reduced generally cylindrical neck portion extending axially substantially from the inner face of said flange to the inner axial extremity of said sleeve to form, in effect, said fuse-like area.

3. The apparatus of claim 1, wherein said reduced neck portion is a reduced flattened neck portion with the radially widest portion thereof serving as said flange, said flattening neck portion having an aperture therein axially located on said pin between the extremity of the inner end of said pin and the radially widest neck portion thereof, to form, in effect, said fuse-like area.

4. A hermetic terminal assembly adapted to be hermetically secured to an opening in a motor unit housing comprising: a cover member having at least one hole therein; a current conducting pin extending through said hole, said pin having an outer end to extend externally of said housing to receive an electrical connection to a current source and an inner end to extend within said housing to receive an electrical connection to a motor disposed in said housing, said inner end of said pin having a flange extending generally radially therefrom, said flange having an inner face facing said inner end of said pin and an opposite face facing said outer end of said pin; a seal bonding said pin to the inside surface defining said cover member hole; and a hollow electrically insulating sleeve surrounding said pin and said flange extending therefrom with the inner axial extremity of said sleeve extending at an axial location relative said pin substantially beyond the axial location of the inner face of said flange and the opposite axial extremity of said sleeve being bonded to said seal to provide an extended tortuous path between said flange on said pin and said cover member to minimize the possibilities of electrical arcing therebetween, said inner end of said pin having a reduced flattened neck portion with the radially widest portion thereof serving as said flange, said flattened neck portion having an aperture therein axially located on said pin between the extremity of the inner end of said pin and the radially widest neck portion thereof, to form, in effect, a fuse-like area.

5. A hermetic terminal assembly adapted to be hermetically secured to an opening in a motor unit housing comprising: a cover member having at least one hole therein; a current conducting pin extending through said hole, said pin having an outer end to extend externally of said housing to receive an electrical connection to a current source and an inner end to extend within said housing to receive an electrical connection to a motor disposed in said housing, said inner end of said pin having a flange extending generally radially therefrom, said flange having an inner face facing said inner end of said pin and an opposite face facing said outer end of said pin; a seal bonding said pin to the inside surface defining said cover member hole; and a hollow electrically insulating sleeve surrounding said pin and said flange extending therefrom with the inner axial extremity of said sleeve extending at an axial location relative said pin substantially beyond the axial location of the inner face of said flange and the opposite axial extremity of said sleeve being bonded to said seal to provide an extended tortuous path between said flange on said pin and said cover member to minimize the possibilities of electrical arcing therebetween, the opposite face of said flange being axially spaced from the inner wall of said opposite extremity of said sleeve to accommodate for different coefficients of expansion of differing materials.

6. A hermetic terminal assembly adapted to be hermetically secured to an opening in a motor unit housing comprising: a cover member having at least one hole therein; a current conducting pin extending through said hole, said pin having an outer end to extend externally of said housing to receive an electrical connection to a current source and an inner end to extend within said housing to receive an electrical connection to a motor disposed in said housing, said inner end of said pin having a flange extending generally radially therefrom, said flange having an inner face facing said inner end of said pin and an opposite face facing said outer end of said pin; a seal bonding said pin to the inside surface defining said cover member hole; and a hollow electrically insulating sleeve surrounding said pin and said flange extending therefrom with the inner axial extremity of said sleeve extending at an axial location relative said pin substantially beyond the axial location of the inner face of said flange and the opposite axial extremity of said sleeve being bonded to said seal to provide an extended tortuous path between said flange on said pin and said cover member to minimize the possibilities of electrical arcing therebetween, said insulating sleeve including a generally truncated cone portion with the outer wall extremity thereof sized to nest with said hole and engaging with and being bonded to said seal, said extremity of said truncated cone portion of said insulating sleeve having a generally cylindrical extension with the outer wall diameter thereof sized to nest closely with said hole and engaging with and being bonded to said seal, the inner wall extremity of said hole being tapered to conform with the tapered outer wall of said generally truncated cone portion of said sleeve which bears thereagainst, the inner wall of said truncated cone portion of said insulating sleeve including an annular ledge of a diameter less than the diameter of said flange of said pin to arrest said flange in the event of pin melting, the diameter of said flange being less than the diameter of said hole, said pin and flange being formed from stainless steel with the opposite face of said flange being axially spaced from the annular ledge on the inner wall of said truncated portion of said insulating sleeve to accommodate the different coefficients of expansion of differing materials.

* * * * *